US008459831B2

(12) United States Patent
Hsia et al.

(10) Patent No.: US 8,459,831 B2
(45) **Date of Patent: *Jun. 11, 2013**

(54) LINEAR SOLID-STATE LIGHTING FREE OF SHOCK HAZARD

(75) Inventors: Chungho Hsia, San Jose, CA (US); Pai-Sheng Shen, Bellevue, WA (US); Ching-Feng Lin, Taipei (TW)

(73) Assignee: Lightel Technologies, Inc., Renton, WA (US)

( * ) Notice: Subject to any disclaimer, the term of this patent is extended or adjusted under 35 U.S.C. 154(b) by 262 days.

This patent is subject to a terminal disclaimer.

(21) Appl. No.: 13/025,136

(22) Filed: Feb. 10, 2011

(65) Prior Publication Data

US 2012/0051040 A1 Mar. 1, 2012

Related U.S. Application Data

(63) Continuation-in-part of application No. 12/871,905, filed on Aug. 30, 2010, now Pat. No. 8,322,878.

(51) Int. Cl.

| | |
|---|---|
| ***F21V 23/04*** | (2006.01) |
| ***F21V 23/06*** | (2006.01) |
| ***F21V 29/00*** | (2006.01) |
| ***H01R 33/96*** | (2006.01) |
| ***H01R 29/00*** | (2006.01) |

(52) U.S. Cl.
USPC ..... 362/221; 362/217.1; 362/218; 362/394; 20/51.09; 439/188

(58) Field of Classification Search
USPC ..... 362/217.1, 221, 249.02–249.06, 362/294, 373, 218, 264, 345; 439/188, 231; 200/51.09; 165/172–176; 313/46
See application file for complete search history.

(56) References Cited

U.S. PATENT DOCUMENTS

| | | | | |
|---|---|---|---|---|
| 5,118,301 | A * | 6/1992 | Bentivolio | 439/188 |
| 6,061,243 | A * | 5/2000 | Barnett et al. | 165/80.3 |
| 7,147,041 | B2 * | 12/2006 | Mitchell et al. | 165/80.3 |
| 7,470,055 | B2 * | 12/2008 | Hacker et al. | 362/225 |
| 7,665,862 | B2 * | 2/2010 | Villard | 362/249.02 |
| 7,674,016 | B2 * | 3/2010 | Zhang et al. | 362/294 |
| 7,722,221 | B2 * | 5/2010 | Chae | 362/294 |
| 7,744,252 | B2 * | 6/2010 | Maxik | 362/294 |
| 7,974,099 | B2 * | 7/2011 | Grajcar | 361/720 |
| 7,976,196 | B2 * | 7/2011 | Ivey et al. | 362/294 |
| 8,147,091 | B2 * | 4/2012 | Hsia et al. | 362/221 |
| 8,262,249 | B2 * | 9/2012 | Hsia et al. | 362/217.1 |
| 2009/0219713 | A1 * | 9/2009 | Siemiet et al. | 362/218 |

* cited by examiner

*Primary Examiner* — Alan Cariaso
(74) *Attorney, Agent, or Firm* — Pai Patent & Trademark Law Firm; Chao-Chang David Pai

(57) ABSTRACT

A linear light-emitting diode (LED)-based solid-state lamp having an electrically insulating heat sink that comprises a honeycomb structure is used to replace a conventional metallic one for efficiently dissipating the heat generated by operating the lamp. The lamp further built with a pair of shock protection switches can operate free of electric shock hazard.

10 Claims, 6 Drawing Sheets

LINEAR SOLID-STATE LIGHTING FREE OF SHOCK HAZARD

CROSS-REFERENCE TO RELATED APPLICATIONS

This application is a continuation-in-part of U.S. patent application Ser. No. 12/871,905, filed Aug. 30, 2010, now pending. The prior application is incorporated herein by reference in its entirety.

BACKGROUND OF THE INVENTION

1. Field of the Invention

This invention relates to linear light-emitting diode (LED) lamps and more particularly to a linear LED lamp free of shock hazard.

2. Description of the Related Art

Solid-state lighting (SSL) using light-emitting diodes (LEDs) has received much attention in general lighting applications today. It is expected that such SSL will be a mainstream in the near future because of its potential for more energy savings, better environmental protection (no hazardous materials used), higher efficiency, smaller size, and much longer lifetime than conventional incandescent bulbs and fluorescent tubes. As LED technologies develop with the drive for higher energy efficiency and cleaner technologies worldwide, more families and organizations will adopt LED lighting for their illumination applications. In this trend, the potential safety concerns such as risk of electric shock become much more important and need to be well addressed.

In retrofit application of a linear LED (LL) lamp to replace an existing fluorescent tube, one must remove the starter or ballast because the LL lamp does not need a high voltage to ionize the gases inside the gas-filled fluorescent tube before sustaining continuous lighting. LL lamps operating at AC mains, such as 110, 220, or 277 VAC, have one construction issue related to product safety, which needs to be resolved prior to wide acceptance. This kind of LL lamps always fails a safety test, which measures through lamp leakage current. Because the line and the neutral of the AC main apply to both opposite ends of the tube lamp when connected, the measurement of current leakage from one end to the other consistently results in a substantial current flow, which may present a risk of shock during relamping.

LEDs have a long operating life of 50,000 hours, much longer than conventional lighting devices do. One of the most important factors that detrimentally affect the operating life of an LED-based lamp is high junction temperature of LEDs. While LEDs can operate 50,000 hours, the LED lamps do need a good thermal management in their heat sink design. A more efficient heat sink can effectively maintain the LED junction temperature at a lower value and thus prolong the operating life of LEDs. Conventionally, the most cost-effective heat sink is made of metal. One of the drawbacks of using a metal as a heat sink in LL lamp application is electrical conductivity because a shock hazard may occur when consumers touch the heat sink that is not well insulated from the LED printed circuit board (PCB) and the internal driver that powers the LEDs.

Today, such LL lamps are mostly used in a ceiling light fixture with a power switch on the wall. The ceiling light fixture could be an existing one used with fluorescent tubes but retrofitted for LL lamps or a specific LL lamp fixture. The drivers that provide a proper voltage and current to LEDs could be internal or external ones. An LL lamp with an external driver uses a remote driver that provides a low DC voltage to the lamp and is thus inherently electric-shock free if the driver meets the dielectric withstand standard used in the industry. On the other hand, LL lamps with an internal driver and a metallic heat sink present the shock hazard during relamping or maintenance, as mentioned in the previous paragraph, when a substantial leakage current flows from any one of AC voltage input through the metallic heat sink to the earth ground. Despite this disadvantage, LL lamps with an internal driver and a metallic heat sink still receive acceptance because they provide a long life, a stand-alone functionality, and an easy retrofit for an LL lamp fixture.

Any LL lamps will more or less produce a small amount of leakage current through an internal electrical contact and the metallic heat sink because of the voltages applied and internal capacitance present in the lamps. When there exist design flaws, such as un-isolated design of an LED driver, or material and workmanship defects, the electrical insulation in the LL lamp can break down, resulting in a substantial leakage current flow. It mostly happens for small gaps between current-carrying conductors and the earth ground. When an LL lamp is operated under normal conditions, environmental factors such as dirt, contaminants, humidity, vibration, and mechanical shock can weaken the insulation and facilitate the current to flow through these small gaps, thus creating a shock hazard to anyone who comes into contact with the metallic heat sink on the faulty LL lamps if care is not well taken.

As consumerism develops, consumer product safety becomes extremely important. Any products with electric shock hazards and risk of injuries or deaths are absolutely not acceptable to consumers. However, commercially available LL lamps with internal drivers and a metallic sink, which are used to replace fluorescent tubes, fail to provide a solution to these problems. In the present invention, an electrically insulating but thermally conductive heat sink with an efficient heat-dissipation structure in addition to two shock protection switches used on the lamp bases is adopted to fully protect consumers from possible electric shock injuries and deaths during relamping or maintenance.

Referring to FIG. 1 and FIG. 2, a conventional LL lamp 100 without shock protection switch comprises a metallic housing 110, which also serves as a heat sink, with a length much greater than its radius, two end caps 120 and 130 each with a bi-pin 180 and 190 (not shown in FIG. 1) respectively on two opposite ends of the metallic housing 110, LED arrays 140 with a plurality of LEDs 170 on an LED PCB 150, and an LED driver 160 used to generate a proper DC voltage from the energy supply of the AC main through internal electrical wires 151 and 152 and to provide a proper current to supply the LED arrays 140 through an internal wire connection 161 and 162 such that the LEDs 170 on the PCB 150 can emit light. The LED PCB 150 is glued on a surface of metallic housing 110 by an adhesive with its normal parallel to the illumination direction. The bi-pins 180 and 190 on the two end caps 120 and 130 are electrically connected to an AC main, either 110 V, 220 V, or 277 VAC, through two electrical lamp sockets (not shown) located lengthways in an existing fluorescent tube fixture (not shown). The two lamp sockets in the fixture are electrically connected to the line (L) and the neutral (N) wire of the AC main, respectively.

To replace a fluorescent tube with an LL lamp 100, one inserts the bi-pin 180 at one end of the LL lamp 100 into one of the two lamp sockets in the fixture and then inserts the bi-pin 190 at the other end of the LL lamp 100 into the other lamp socket in the fixture. When the line of the AC main applies to the bi-pin 180 through a lamp socket, there exists a shock hazard as long as the bi-pin 190 at the other end is not in the lamp socket because consumers who replace the linear LED lamp may touch the exposed bi-pin 190. The excessive current will flow from the bi-pin 180, the internal wire 151, the driver 160, the internal wire 152, and the bi-pin 190 to earth through his or her body—a shock hazard. This is most likely to happen in practice. To prevent consumers from injury for this shock hazard, Underwriters Laboratories (UL), uses its standard, UL 935, Risk of Shock During Relamping (Through Lamp), to do the current leakage test and to determine if LL lamps under test meet the consumer safety requirement.

On the other hand, when the line or neutral wire of the AC main is connected to the bi-pin 180 through a lamp socket, no matter whether the bi-pin 190 at the other end is in the lamp socket or not, there exists another shock hazard because at this time, if a high voltage from a lighting strike, for example, applies to the AC main of the LL lamp, which happens to be a faulty one as mentioned above, a high voltage breakdown, from the insulation-weakest point along an electrical path from the bi-pin 180, through the internal wires 151, 161, and 162, the LED driver 160, and LED arrays 140 on the LED PCB, to the heat sink 110, will lead to an excessive leakage current flow to the heat sink 110. At this time, if the person who replaces the LL lamp 100 touches the housing 110, he or she will get electric shock because the current flows to earth through his or her body. This is also likely to happen in practice. To prevent consumers from injury due to this shock hazard, UL uses one of the procedures in UL 1993 Standards, Dielectric Voltage-Withstand Test, to determine if LL lamps under test meet the consumer safety requirements.

When an LL lamp is used as a lighting source, consumers used to use a power switch on the wall to turn the LL lamp power on or off. Intuitively, they just turn the LL lamp power off during relamping or maintenance and presume that it is safe without any shock hazards. But in practice, if the wiring is such that the neutral wire goes to the switch while the hot wire is connected all the time to the LL lamp fixture, then there exists shock hazards during relamping and maintenance because the consumers may touch the exposed bi-pin when the other bi-pin is still in the electric lamp socket. One of the solutions is to use two shock protection switches, one each on the two ends, such that the leakage current is blocked when either one of bi-pins is out of the lamp socket.

On the other hand, if the housing of an LL lamp is metallic, then there exists another shock hazard to the person who replaces the LL lamp and touches the housing if high voltage spikes occur. One solution is to use a facility switch on the LL lamp to manually turn off the internal electrical connections prior to replacement or maintenance. But in practice, the installation instruction in which the safety procedures are described may not be followed by a consumer, and thus the shock hazard is still a safety issue. It is, therefore, a responsibility of a lighting manufacturer to provide such an LL lamp with 100% safety guaranteed by design. In this case, the solution is to adopt an electrically insulating but thermally conductive heat sink, preferably made of amorphous plastic, such as TARFLON® Polycarbonate G131Z1, or thermoplastic, such as Stanyl® TC 153 and TC 501, to replace the metallic one.

Plastic-based materials are widely used in many applications from consumer products to aerospace structures. But such materials have never been used LL lamps as a heat sink. A basic plastic material is either not rigid enough to support a fine honeycomb structure in long length applications such as 2-, 4-, and 5-foot LL lamps, or its thermal conductivity, 0.04~0.5 W/m° K, not high enough to efficiently conduct the heat generated by operating LEDs to the outer surface, resulting in a shortened LED life. On the contrary, the amorphous plastic or thermoplastic used in the LL lamps according to this invention provide much higher mechanical strength and thermal conductivities than pure plastics do. However, such a plastic heat sink with a simple tube shape alone still cannot dissipate heat as efficiently as aluminum heat sink widely used in the LL lamp applications. Therefore, one needs to use a more complex heat sink structure to improve heat dissipation.

Fortunately, current technology of injection molding can be used cost-effectively with the thermally conductive plastics to build not only a simple toothed but a complex honeycomb structure. Nevertheless, it can only produce an object of a length about 20 centimeters. Ultrasonic welding is thus needed for joining such plastic sections to achieve the desirable lengths for the heat sink. The process by which high-frequency vibration energy is directed to the interfaces to be joined is rapid and can be automated. The welding automation that integrates several modules used in the LL lamps also makes mass production and low cost possible, which helps such solid-state devices find faster adoption in general lighting applications to save energy and protect environments.

SUMMARY OF THE INVENTION

The present invention uses an electrically insulating but thermally conductive heat sink with a honeycomb structure in a linear light-emitting diode (LED) lamp (LL lamp) to efficiently dissipate the heat generated by operating the LEDs and thus to maintain their longevity. An electrically insulating heat sink such as plastic one alone cannot provide a satisfactory thermal management and thus has a very limited application in LL lamps. The innovative heat sink used in the present invention, however, can be used to replace a conventional metallic one because it further provides some advantages over the latter, such as greater degree of design freedom, lighter weight, wider use of non-isolated driver, safer, etc. The lamp further comprising an LED driver, an LED printed circuit board (PCB) with a plurality of LEDs, a lens, and an electrical shock protection mechanism, can be used to replace a fluorescent tube in an existing lamp fixture. The shock protection mechanism can automatically shut off the internal electrical connections when either one of bi-pins at the ends is out of the lamp socket. In such a scheme with the electrically insulating heat sink, no line voltage or accidental high voltage spikes will possibly occur between the activated and the exposed bi-pins and between any of the bi-pins and the electrically insulating heat sink during relamping or maintenance. Thus, any leakage current that may cause shock hazards is completely eliminated.

DETAILED DESCRIPTION OF THE INVENTION

Figure 1:
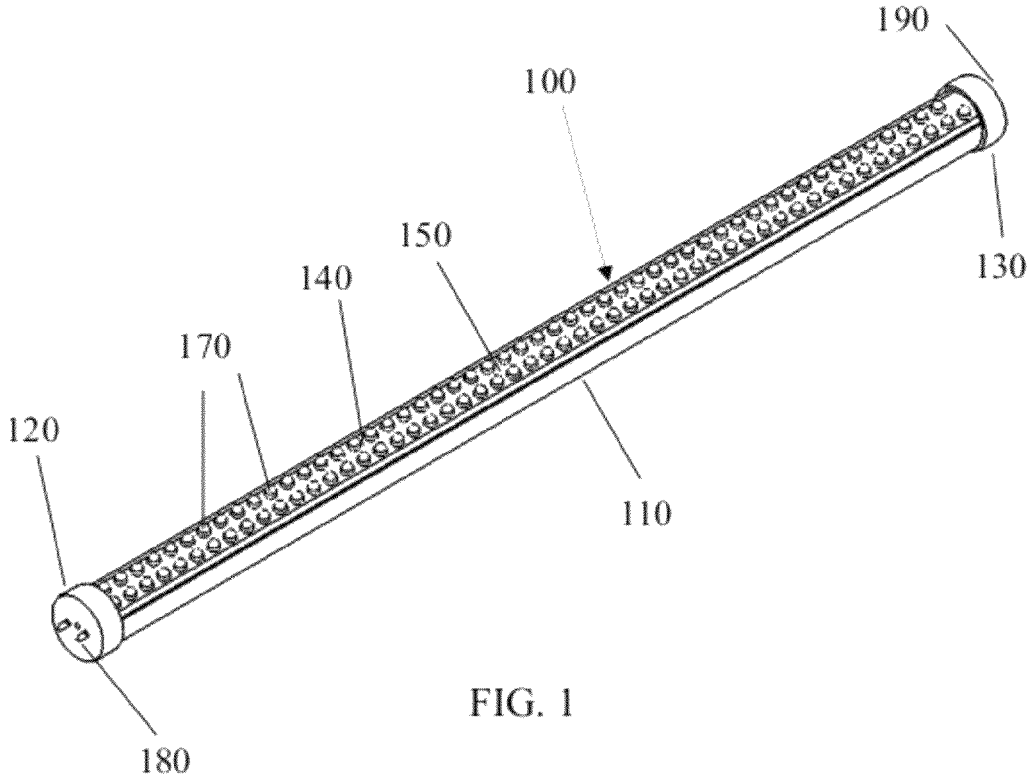
FIG. 1 PRIOR ART
FIG. 1 is an illustration of a conventional LL lamp using metallic heat sink without shock protection switches.
Figure 2:
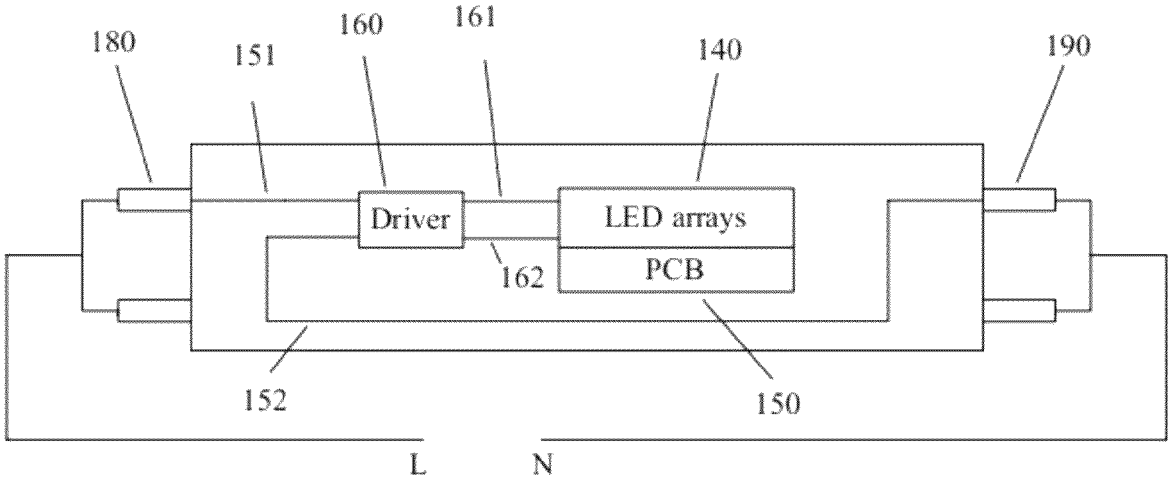
FIG. 2 PRIOR ART
FIG. 2 is a functional block diagram of a conventional LL lamp.
Figure 3:
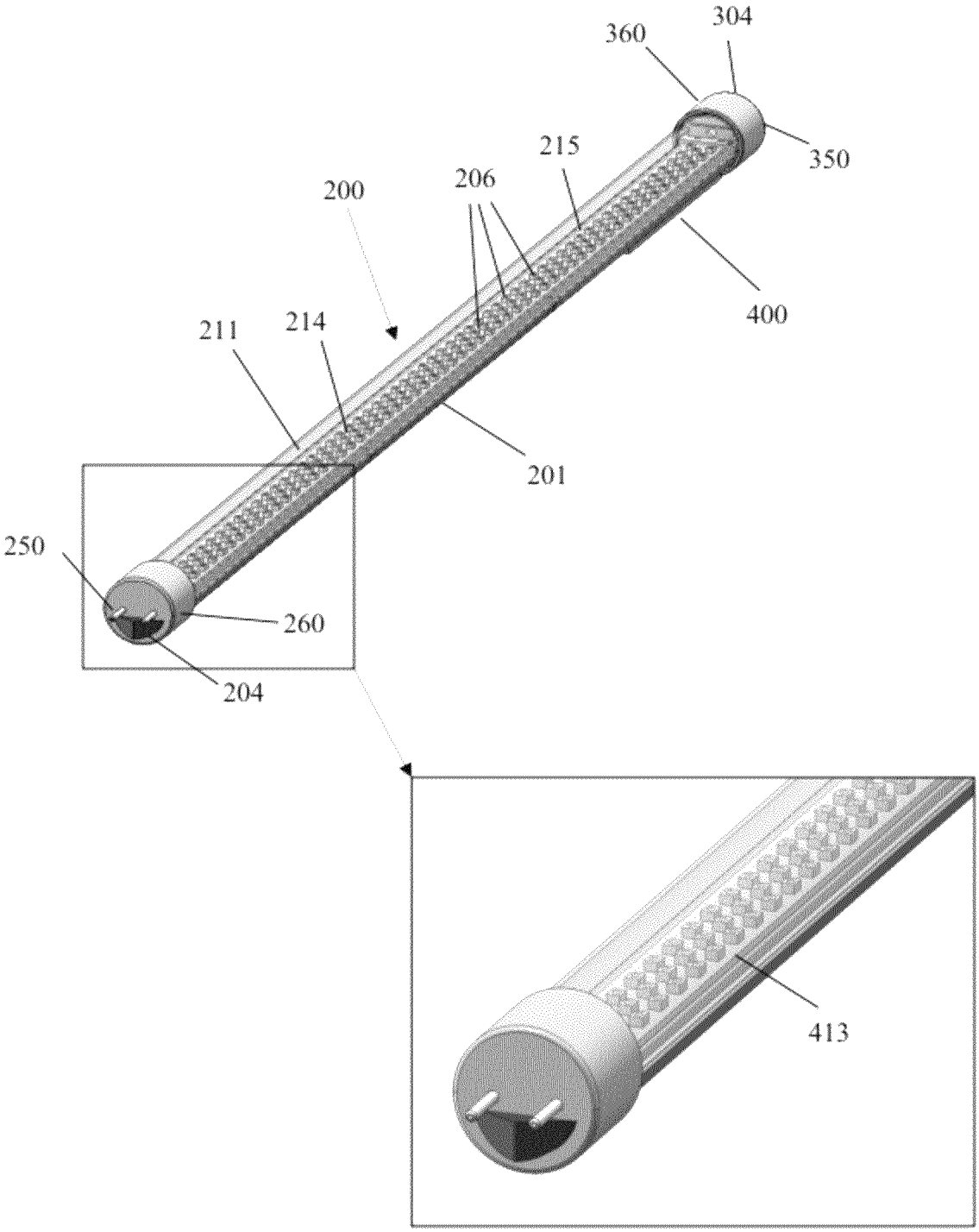
FIG. 3 is an illustration of a shock hazard-free LL lamp with shock-protection switches and an electrically insulating but thermally conductive heat sink according to the present invention.
Figure 4:
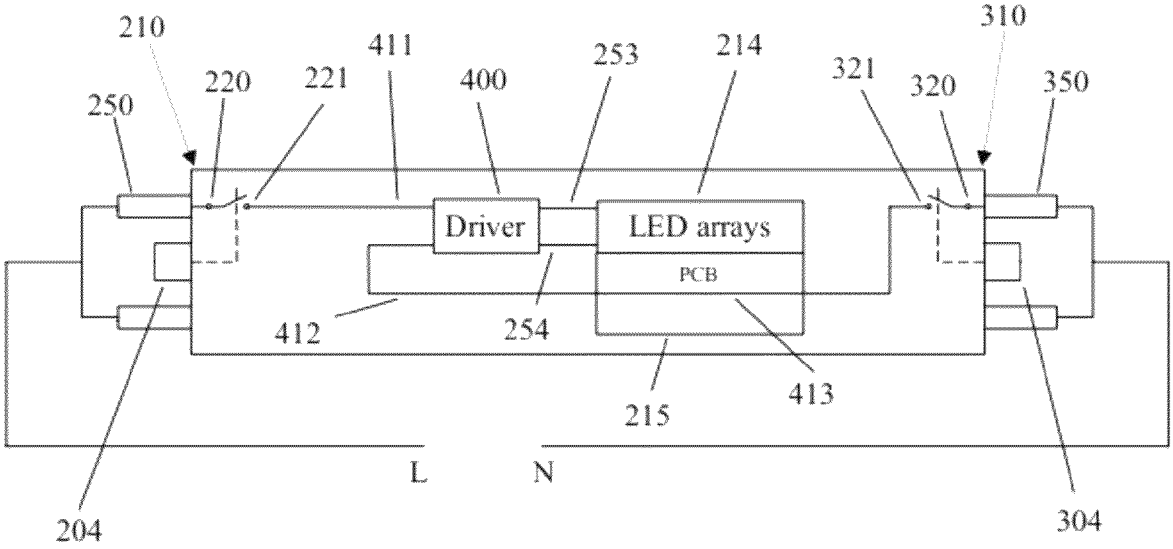
FIG. 4 is a functional block diagram of a shock hazard-free LL lamp with two end shock protection switches at both ends of the LL lamp according to the present invention.

FIG. 3, in conjunction with FIG. 4, is an illustration of an LL lamp with an electrically insulating but thermally conductive heat sink and two shock protection switches at both ends according to the present invention. The LL lamp 200 has a housing 201, a lens 211, an LED driver 400, two lamp bases 260 and 360, one at each end of the housing 201, two bi-pins 250 and 350 (not shown), two actuation mechanisms 204 and 304 (not shown) for the shock protection switches, one each in the two lamp bases 260 and 360, and an LED array 214 on an LED PCB 215, on a flat surface of the housing 201 with a plurality of LEDs 206. To electrically connect the power from the bi-pins 250 to the LED driver 400, which is located at one side of the LL lamp, a printed circuit strip-on-board 413 on the LED PCB 215 is used (see inset drawing in FIG. 3). The housing 201, made of thermally conductive plastics, preferably amorphous plastic or thermoplastic, as mentioned with thermal conductivities greater than or equal to 5.0 W/m° K, serves also as a heat sink with a honeycomb structure to enhance the heat dissipation (shown in FIGS. 5, 6, and 7 for better illustration). When an LL lamp uses an external driver, a low DC voltage is applied to the bi-pins, and thus the shock protection switches are not needed. The operation of such lamps is the same as mentioned above except that there is no internal LED driver 400.

FIG. 4 is a functional block diagram of an LL lamp with an electrically insulating heat sink and two shock protection switches at both ends of the LL lamp according to the present invention. The shock protection switch 210 comprises two electrical contacts 220 and 221 and one actuation mechanism 204. Similarly, an end shock protection switch 310 comprises two electrical contacts 320 and 321 and one actuation mechanism 304. The shock protection switches 210 and 310 are a type of momentary switch, normally "off", which can be of a contact type (such as a snap switch, a push-button switch, rotary switch, or a micro switch) or of a non-contact type (such as electro-mechanical, magnetic, optical, electro-optic, fiber-optic, infrared, or wireless based). The proximity control or sensing range of the non-contact type protection switch is normally up to 8 mm. The lamp bases 260 and 360 use the bi-pin 250 and 350 to connect the AC main to the LED driver 400 through the shock protection switches 210 and 310, normally in "off" state. When pressed in, the actuation mechanism 204 actuates the switch 210 and turns on the connection between the AC main and the LED driver 400 through an internal wire connection 411. Similarly, when pressed in, the actuation mechanism 304 actuates the switch 310 and turns on the connection between the AC main and the LED driver 400 through an internal wire connection 412 and a printed circuit strip-on-board 413 on the LED PCB 215. The use of the printed circuit strip-on-board 413 on the LED PCB 215 is necessary to electrically connect the bi-pin 350 to the driver 400 located opposite to the bi-pin 350 lengthways because no hollow space is available to accommodate a long wire from one end to the other end of the lamp for this innovative heat sink design.

Even with the two shock protection switches, one each on the two ends, when such an LL lamp is in the fixture with two bi-pins in the lamp socket, the LL lamp is still vulnerable to another shock hazard due to high voltage breakdown because consumers must touch the metallic heat sink to do maintenance. This happens when a high voltage spike appears at either one of the bi-pins, and a high voltage breakdown occurs along the way through the internal wire connections 411 and 412, the LED driver 400, the internal wire connections 253, and 254, a printed circuit strip-on-board 413, and the LED arrays 214 on the LED PCB 215 to the heat sink 201 if metallic one is used. If this is the case, an excessive leakage current will flow from the breakdown point to the heat sink 201. A high voltage spike such as 1300 or 4000 volts can break down a faulty LL lamp, which has a problematic driver or heat sink design, bad workmanship, or is affected by certain detrimental environmental factors. For example, an unisolated driver design might result from an insufficient insulation between input and output circuits. A problematic heat sink design might result from an insufficient distance of the air gap between the conductors in the lamp and the heat sink. When there exist material and workmanship defects, the environmental factors such as dirt, contaminants, humidity, vibration, and mechanical shock will reduce the breakdown voltage and facilitate a current flow through an insulation breakdown point. This condition can create a shock hazard to anyone who comes into contact with the metallic heat sink on the faulty LL lamps if care is not well taken.

Figure 5:
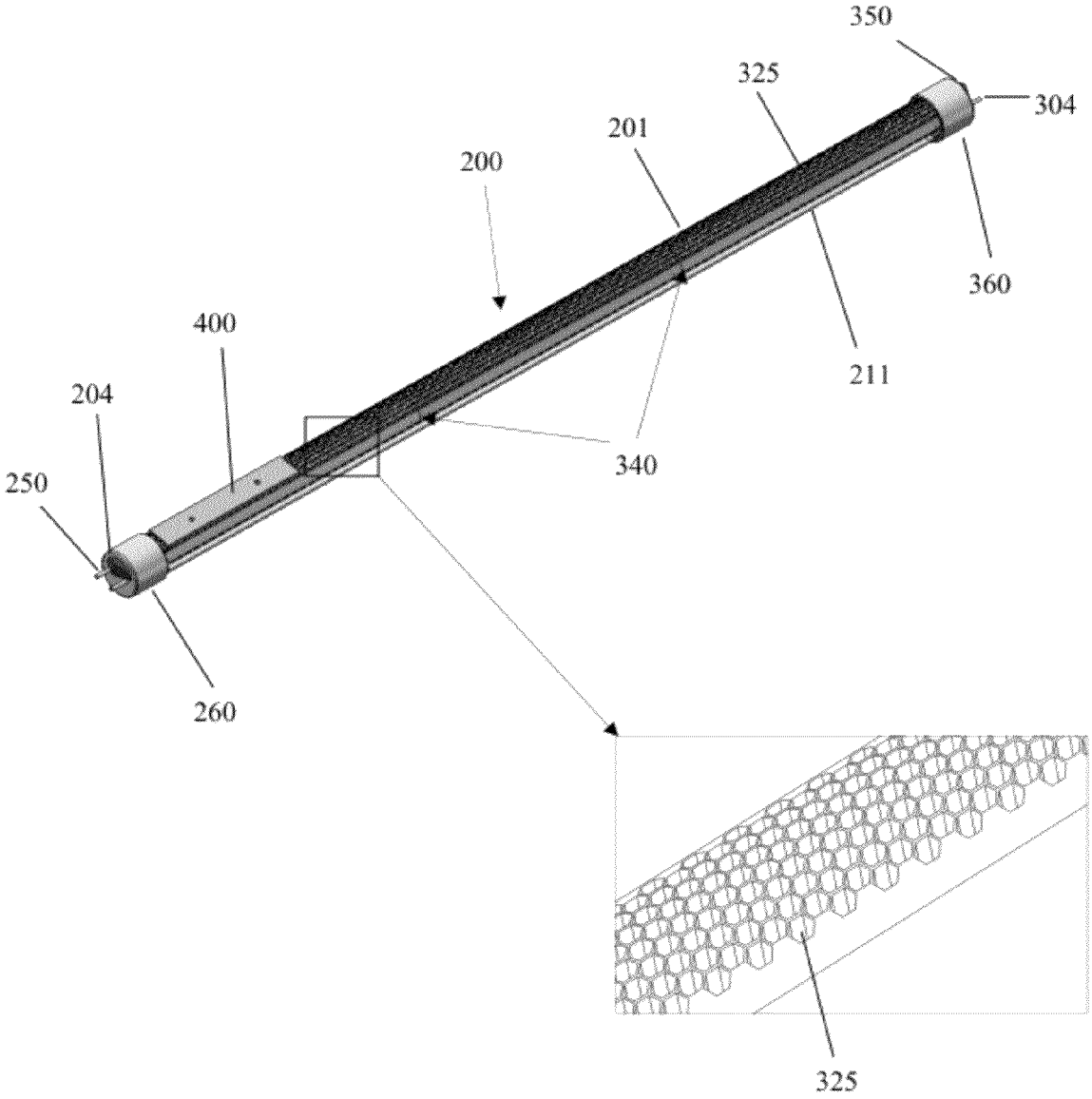
FIG. 5 is an illustration of a shock hazard-free LL lamp with an electrically insulating but thermally conductive heat sink according to the present invention.

One of the solutions is to use a utility shock protection switch on the heat sink. But it relies on consumers to manually shut off the power connections such that the faulty electric current flows between the power line and a metallic heat sink are interrupted. The present invention uses an electrically insulating heat sink to block the faulty current flow from the power line to the heat sink. This fundamentally solves the high voltage breakdown problem and protects consumers from such shock hazard. Other advantages over metallic heat sink include greater degree of heat sink design freedom, lighter weight, wider use of non-isolated driver, safer, etc. To further improve heat dissipation so as to maintain the LED junction temperature to an acceptable level, a honeycomb or similar heat dispersion structure must be used. FIG. 5 is another illustration of FIG. 3 with the honeycomb structure. As shown, the LL lamp 200 has an electrically insulating housing 201, which also serves as the heat sink, with a honeycomb heat dissipation structure 325 The housing 201 comprises sections of sub-housing with interfaces 340 to be joined. Using ultrasonic welding at the interfaces, separate sections of plastic heat sink can be melted and then solidified into a single complete housing with the joints as strong as the individual sections. Shown in the inset of FIG. 5 is the expanded view of the honeycomb structure with a plurality of hexagonal cells. The structure has the geometry that allows the minimal amount of material used to reach minimal weight and thus minimal material cost. Although the geometry of the structure may differ, such structures have a plurality of hollow cells, hexagonal or columnar in profile, configured in a 2-D array, and separated by vertical walls to facilitate heat dissipation. Besides, the structure provides relatively high compression and shear strengths that can protect the lamps with such a plastic housing from being deformed or torn apart accidentally. Other types of the hollow cell such as circular, elliptical, triangular, rectangular, trapezoidal, polygonal, can be formed for improved heat dissipation.

Figure 6:
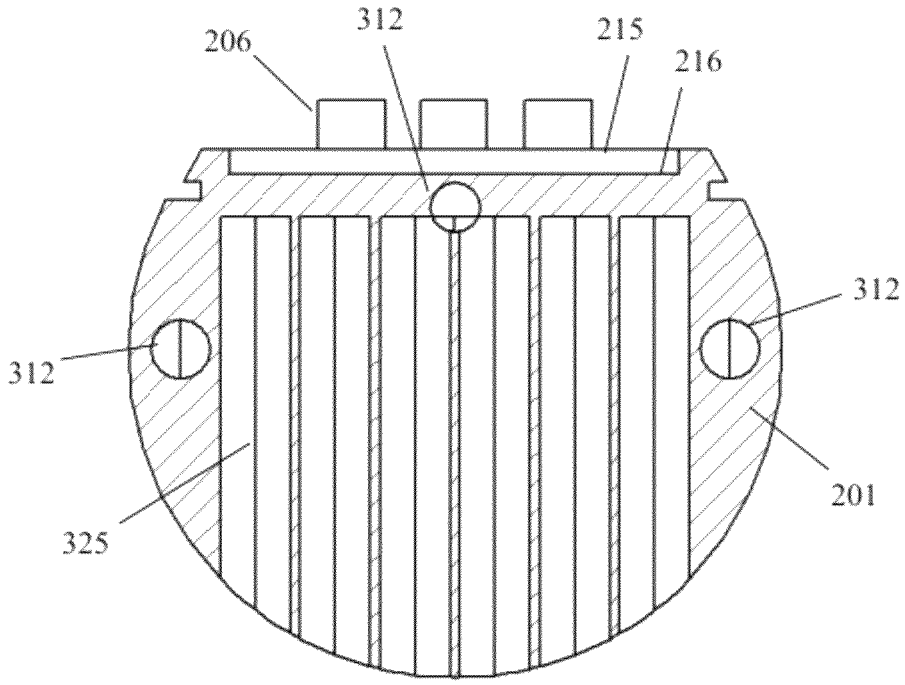
FIG. 6 is a section view of a shock hazard-free LL lamp with an electrically insulating but thermally conductive heat sink according to the present invention.
Figure 7:
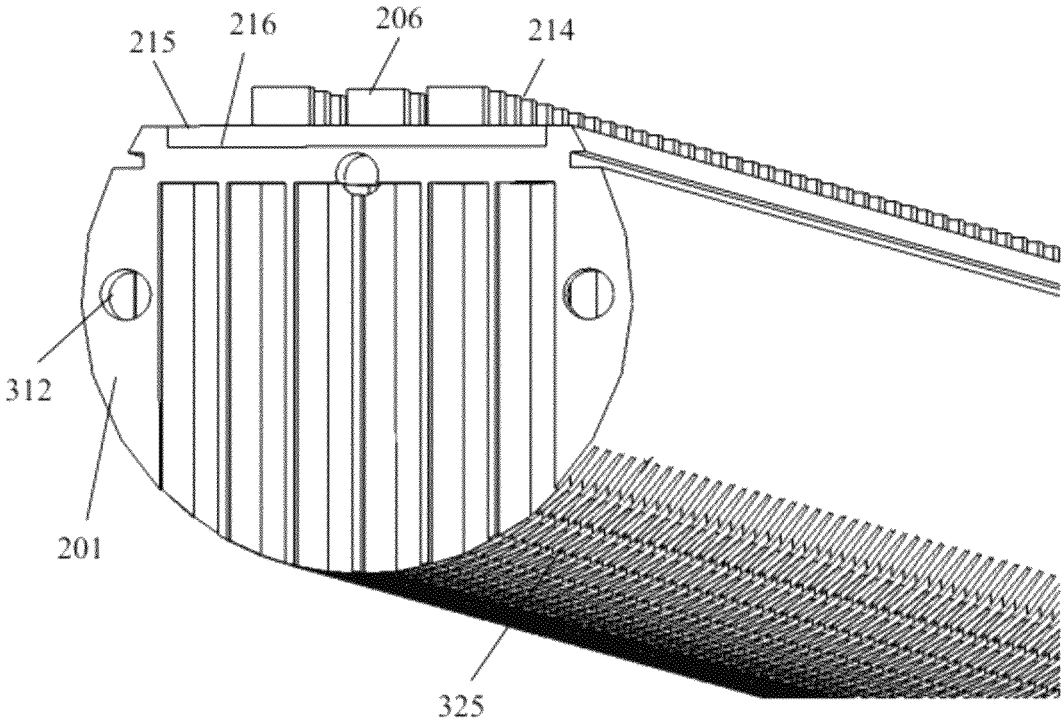
FIG. 7 is an illustration of a honeycomb structure in a shock hazard-free LL lamp with an electrically insulating but thermally conductive heat sink according to the present invention.

FIG. 6 is a section view of an LL lamp with an electrically insulating heat sink with the lens omitted for clarity. FIG. 7 is a perspective view of FIG. 6 to show a honeycomb structure of the heat sink. The heat generated by operating a plurality of LEDs 206 is conducted to the heat sink 201 through the LED PCB 215, on a flat surface 216 of the housing 201. The honeycomb structure 325 is designed to help reduce its thermal resistance, increase surface area, and improve heat transfer efficiency. In FIG. 7, the positioning holes 312 and matching pins (not shown) are used to help align the parts more precisely, thus facilitating ultrasonic welding, enhancing the bonding strength, and achieving a seamless joint on the interface between the sub-housing sections that are jointed to achieve desired lengths.

The electrically insulating heat sink and shock protection switch approach can be used in an LL lamp for shock hazard-free operation. It seems straightforward but LL lamp manufacturers have failed to recognize the potential shock hazard and to provide such products without any protection mechanism to consumers, who then may suffer from a risk of injuries or even deaths.

What is claimed is:

1. A linear light-emitting diode (LED) lamp, comprising:

a housing having a honeycomb structure with a plurality of cells and having two ends;

a light-emitting diode printed circuit board (LED PCB) fixed on a surface of the housing between the two ends, the LED PCB having a plurality of LEDs fixed thereon;

an LED driver that powers the plurality of LEDs on the LED PCB, the LED driver having two inputs;

two lamp bases respectively connected to the two ends of the housing, each lamp base comprising an end face, a bi-pin with two pins protruding outwards through the end face, and a shock protection switch connected with the bi-pin on the lamp base, wherein: when the bi-pin is inserted into a lamp socket, the shock protection switch is actuated to electrically connect the bi-pin with a respective one of the inputs of the LED driver; and when the shock protection switch is unactuated, the bi-pin is electrically disconnected from the respective input of the LED driver.

2. The linear LED lamp of claim 1, wherein the LED PCB has a printed circuit to electrically conduct AC power from one of the shock protection switches to the LED driver.

3. The linear LED lamp of claim 1, wherein the shock protection switch of each of the two lamp bases comprises:

two electrical contacts, one electrically connected with the bi-pin of the respective lamp base, and the other electrically connected with the respective input of the LED driver; and a switch actuation mechanism having a front portion protruding outwards through the end face of the respective lamp base, wherein when the front portion of the switch actuation mechanism is pressed in by inserting the bi-pin of the lamp base into a lamp socket, the two electrical contacts of the shock protection switch are electrically connected to actuate the shock protection switch so that the bi-pin is electrically connected with the respective input of the LED driver.

4. The linear LED lamp of claim 1, wherein the shock protection switches are of a contact type.

5. The linear LED lamp of claim 4, wherein the shock protection switches are each a snap switch, a push-button switch, rotary switch, or a micro switch.

6. The linear LED lamp of claim 1, wherein the shock protection switches are of a non-contact type.

7. The linear LED lamp of claim 6, wherein the shock protection switches are electro-mechanical, magnetic, optical, electro-optic, fiber-optic, infrared, or wireless based.

8. The linear LED lamp of claim 6, wherein the shock protection switches have a proximity control or sensing range up to 8 mm.

9. The linear LED lamp of claim 1, wherein the housing is made of an electrically insulating and thermally conductive material with thermal conductivity greater than or equal to 5.0 W/m° K.

10. The linear LED lamp of claim 1, wherein the cells in the honeycomb structure are circular, elliptical, triangular, rectangular, trapezoidal, hexagonal, or polygonal.

* * * * *